US007390288B2

(12) United States Patent
Giaquinta et al.

(10) Patent No.: US 7,390,288 B2
(45) Date of Patent: Jun. 24, 2008

(54) TRAINING BAG APPARATUS

(75) Inventors: Denise Giaquinta, New York, NY (US); Susan Gionfriddo, Medford, OR (US)

(73) Assignee: Pow-R Productions, LLC, Thousand Oaks, CA (US)

( * ) Notice: Subject to any disclaimer, the term of this patent is extended or adjusted under 35 U.S.C. 154(b) by 28 days.

(21) Appl. No.: 10/897,676

(22) Filed: Jul. 23, 2004

(65) Prior Publication Data

US 2006/0019803 A1 Jan. 26, 2006

(51) Int. Cl.
*A63B 69/34* (2006.01)

(52) U.S. Cl. ..... 482/85; 482/90

(58) Field of Classification Search ..... 482/83–87, 482/90; 473/441, 444, 445; 446/396
See application file for complete search history.

(56) References Cited

U.S. PATENT DOCUMENTS

| | | | | | |
|---|---|---|---|---|---|
| 524,894 | A * | 8/1894 | Forsberg | 482/85 |
| 952,862 | A * | 3/1910 | Armstrong | 482/85 |
| 1,007,628 | A * | 10/1911 | Armstrong | 482/85 |
| 1,020,367 | A * | 3/1912 | Patterson, Jr. | 482/85 |
| 1,099,417 | A * | 6/1914 | Armstrong | 482/85 |
| 1,228,615 | A * | 6/1917 | Stafford | 40/608 |
| 1,425,945 | A * | 8/1922 | Congdon, Jr. | 40/608 |
| 1,620,598 | A * | 3/1927 | Foster | 482/85 |
| 2,037,508 | A * | 4/1936 | Gilman | 473/444 |
| 2,197,545 | A * | 4/1940 | Bachman et al. | 473/444 |
| 2,237,599 | A * | 4/1941 | Gilman | 473/444 |
| 4,176,838 | A * | 12/1979 | Griffin | 473/417 |
| 5,624,358 | A * | 4/1997 | Hestilow | 482/90 |
| 5,941,801 | A * | 8/1999 | D'Alto | 482/90 |
| 6,106,443 | A * | 8/2000 | Kuo | 482/83 |
| 6,110,079 | A * | 8/2000 | Luedke et al. | 482/83 |
| 6,251,051 | B1 * | 6/2001 | Chen | 482/83 |
| 6,390,958 | B1 * | 5/2002 | Chu | 482/90 |
| 6,432,027 | B1 * | 8/2002 | Haselrig | 482/83 |
| 6,461,281 | B2 * | 10/2002 | Bouvier | 482/86 |
| 6,790,167 | B1 * | 9/2004 | Carlin et al. | 482/90 |

FOREIGN PATENT DOCUMENTS

| | | | |
|---|---|---|---|
| EP | 1297867 | A2 * | 4/2003 |
| GB | 2401796 | A * | 11/2004 |
| JP | 08196673 | A * | 8/1996 |

* cited by examiner

*Primary Examiner*—Loan H. Thanh
*Assistant Examiner*—Victor K. Hwang

(57) ABSTRACT

The present invention is directed to a training bag apparatus. A preferred embodiment of the training bag apparatus includes: (a) a base including (1) a bottom part having an upper surface and a lower surface wherein the lower surface has a rounded edge extending around the lower surface and (2) a top part attached to the upper surface of the bottom part of the base; and (b) a column supported on the top part of the base and extending substantially vertically upward from the top part of the base. The column and the base are an integral one-piece unit and move in the same direction when the column is struck.

16 Claims, 7 Drawing Sheets

TRAINING BAG APPARATUS

BACKGROUND OF THE INVENTION

1. Field of the Invention

The present invention relates to fitness equipment and more particularly to training bags for use in boxing, kickboxing and other martial arts.

2. Description of the Prior Art

Several training bags and/or apparatuses are known for use in boxing and the martial arts. For example, U.S. Pat. No. 6,027,435 issued to Nadorf (hereinafter "the '435 patent") discloses a freestanding training bag including a pedestal, a vertical post and a striking pad surrounding the post for being struck by a user. The pedestal of the '435 patent is generally hollow and forms a sealed container for any fluid or liquid material such as water. The training bag of the '435 patent is designed so that when the striking pad is struck, the post is angularly deflected away from its substantially vertical orientation while the pedestal does not move. However, as the pedestal is filled with a fluid, it becomes fatigued over time and is prone to leaks.

In addition, U.S. Pat. No. 5,624,358 issued to Hestilow (hereinafter "the '358 patent") discloses a training bag including a fluid-filled pedestal, a column and a striking pad assembly supported by the column. The training bag of the '358 patent is designed so that when the striking pad assembly is struck, the column moves in a direction away from its substantially vertical orientation and the pedestal does not move. The column, though, rebounds and comes right back at the user and if the user is not ready, he or she may be struck by the column. In addition, the design of the training bag apparatus is such that the energy-absorbing element is the flat deck or upper wall of the pedestal of the training bag apparatus. The deck is constantly inwardly and outwardly deformed. Also, the design may cause the upper wall to undergo fatigue and ultimate failure. Further, as the pedestal is filled with a fluid, it becomes fatigued over time and is prone to leaks.

Several other U.S. patents also disclose training bags and/or apparatuses for use in boxing and the martial arts, for example, U.S. Pat. No. 6,217,489 issued to Nicholson, U.S. Pat. No. 6,110,079 issued to Luedke et al., U.S. Pat. No. 6,080,089 issued to Nicholson, U.S. Pat. No. 5,823,898 issued to Wang, U.S. Pat. No. 5,582,561 issued to Gonzalez and U.S. Pat. No. 5,183,451 issued to Hautamaki. One of the common problems with these training bags and/or apparatuses is that they do not give the desired resistance to punches, jabs and kicks required for a novice.

Accordingly, it is one of the purposes of this invention to provide a training bag apparatus which when struck, will not rebound and hit the user.

Another purpose of this invention is to provide a training bag apparatus that is easy to move.

Yet another purpose of this invention is to provide a training bag apparatus that is simple in construction and inexpensive to manufacture.

SUMMARY OF THE INVENTION

It has now been discovered that these and other purposes can be achieved by the present invention, which provides for a training bag apparatus including a base and a column. The base includes a bottom part and a top part. The bottom part has an upper surface and a lower surface which has a rounded edge extending all the way around it. The bottom part of the base is preferably hollow and is filled with a material having a weight that would allow the base to tilt away from the user when the apparatus is struck by the user, then tilt back towards the user and then tilt back and forth until the apparatus returns to its normal vertical position. The weight of the material should also be sufficient enough to prevent the apparatus from having moved substantially away from the user when the apparatus returns to its normal vertical position. The upper surface preferably has an opening through which the bottom part of the base can be filled with such material. The top part is attached to the upper surface of the bottom part of the base and is done so preferably after the bottom part is filled with such material.

The column is supported on the top part of the base and extends substantially vertically upward from the top part of the base. The column preferably includes foam encased within a sleeve and the sleeve has an end portion extending beyond the column whereby the column is supported on the top part of the base by attaching the end portion of the sleeve to the top part. The column and the base are an integral one-piece unit and move in the same direction when the column is struck.

The present invention also provides for a preferred embodiment which includes a training bag apparatus having a base, a column and a sleeve wherein the column and the base are an integral one-piece unit and move in the same direction when the sleeve is struck. The base has an upper surface and a lower surface which has a rounded edge extending all the way around it. The column has a top end and a bottom end and the bottom end is supported at a central location on the upper surface of the base. Further, the column extends substantially vertically upward from the upper surface of the base. The sleeve is sized and shaped to cover a significant portion of the column and extend onto the upper surface of the base. Also, the sleeve has an edge attached to the upper surface of the base to thereby hold the column on the upper surface of the base.

Another preferred embodiment of the present invention includes a training bag apparatus having a base, a column, a sleeve and a lid wherein the column and the base are an integral one-piece unit and move in the same direction when the sleeve is struck. The base includes a lower surface and an upper surface wherein the lower surface has a rounded edge extending all the way around it and the upper surface has a central receiving region. The column has a bottom end and a top end and the bottom end is received in the central receiving region of the upper surface of the base such that the column extends substantially vertically upward from the base. The sleeve is sized and shaped to cover a significant portion of the column and extend onto the upper surface of the base. The lid has a central opening wherein the lid is sized and shaped to fit over the sleeve and attach to the base such that the lid holds the sleeve and thereby the column in the central receiving region of the upper surface of the base.

BRIEF DESCRIPTION OF THE DRAWINGS

Preferred embodiments of the invention have been chosen for purposes of illustration and description, but are not intended in any way to restrict the scope of the invention. The preferred embodiments of certain aspects of the invention are shown in the accompanying drawings, wherein.

DETAILED DESCRIPTION OF THE INVENTION

Figure 1:
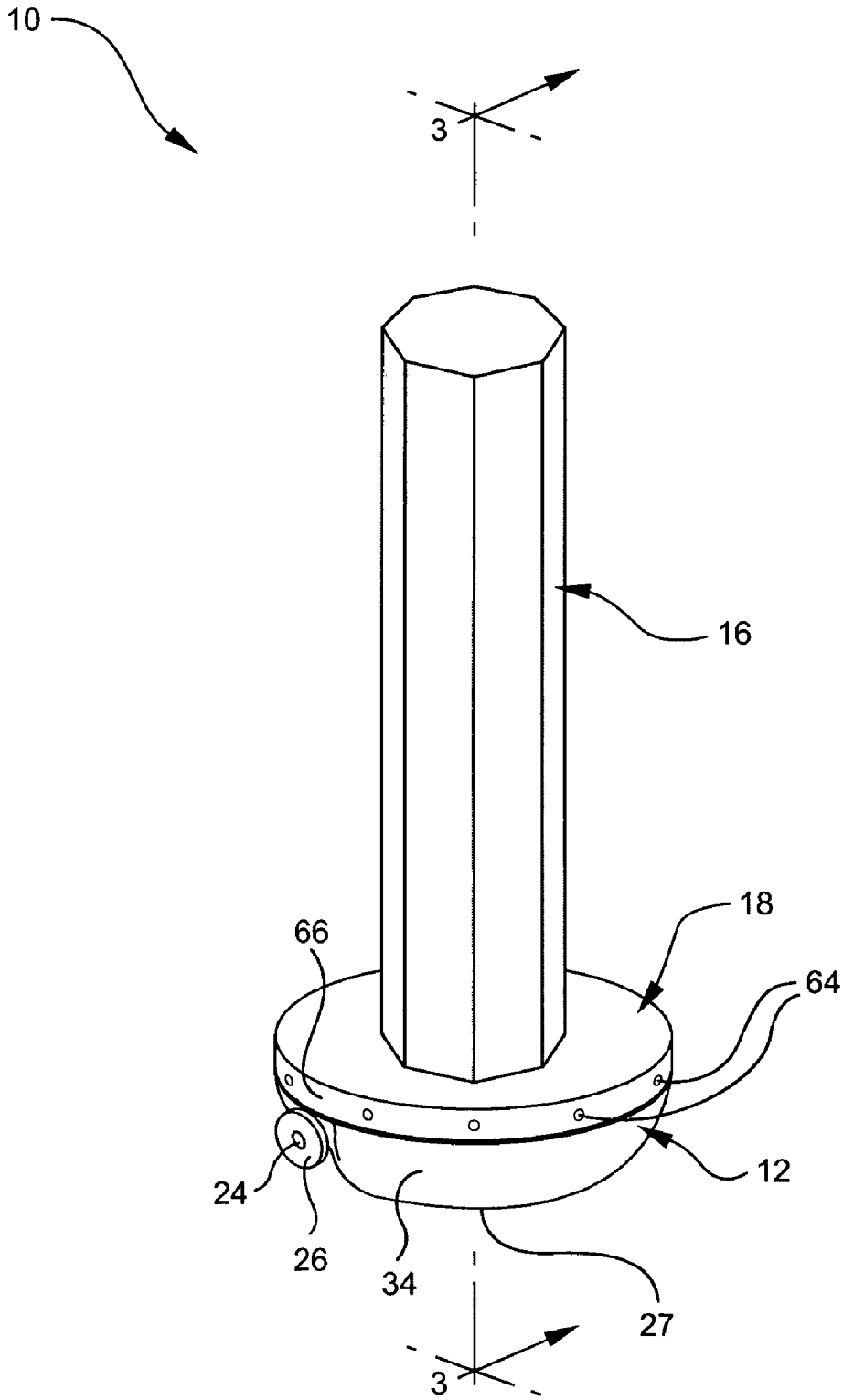
FIG. 1 is a perspective view of a preferred training bag apparatus constructed in accordance with the present invention.

The present invention provides a training bag apparatus including a base and a column wherein the column and the base are an integral one-piece unit and move in the same direction when the column is struck. The base includes a bottom part and a top part. The bottom part has an upper surface and a lower surface which has a rounded edge extending all the way around it.

The bottom part of the base of the training bag apparatus is preferably hollow and is filled with a material having a weight that would allow the base to tilt away from the user on a portion of the rounded edge of its lower surface when the apparatus is struck by the user, then tilt back towards the user on an opposite portion of the rounded edge and then tilt back and forth until the apparatus returns to its normal vertical position. The weight of the material should also be sufficient enough to prevent the apparatus from having moved substantially away from the user when the apparatus returns to its normal vertical position. The upper surface of the bottom part preferably has an opening through which the bottom part of the base can be filled with such material. The bottom part of the base is preferably filled with concrete and/or sand. Concrete and sand can be obtained at several retailers or commercial construction companies.

It should be appreciated that conventional training bags weigh between 40 and 120 pounds. This training bag apparatus of the present invention filled with concrete weighs from about 70 to about 110 pounds and preferably from about 90 to about 100 pounds, but provides better conditioning benefits than heavier or lighter conventional training bags. At this weight, the training bag apparatus, when struck by a user, will tilt away from the user, then tilt back towards the user and then tilt back and forth until returning to its normal vertical position. This weight should also be sufficient enough to prevent the apparatus from having moved substantially away from the user when the apparatus returns to its normal vertical position.

The base is preferably a molded plastic that is hollow. It can be made by several conventional methods including injection fusion molding and blow molding. The plastic preferably has a thickness of from about 0.0625 to about 0.50 inches and more preferably a thickness of about 0.125 inches. Most conventional plastics can be used to make the base as they are not rigid enough to injure a user who inadvertently kicks the base. A preferred plastic for use with the present invention is high density polyethylene which is commercially available from many companies such as Injectron Corporation in Plainfield, N.J.

The base can alternatively be made from wood shaped to have an upper surface and a lower surface with the dimensions set forth herein. In such case, the base should be encased within a rubber mold or other casing which would prevent a user who inadvertently kicks the base from being injured.

The base has a side surface extending all the way around the base. An axle connecting a pair of wheels can extend through a portion of the base on the side surface so that the user can move the training bag apparatus.

Preferably, the upper surface of the bottom part of the base is spaced above the lower surface. It is also preferable that the upper surface has a greater surface area than the lower surface. Further, the upper surface and lower surface can be constructed in a variety of geometric shapes such as square-shaped, rectangular-shaped, circular-shaped, triangular-shaped, hexagonal-shaped and octagonal-shaped. Regardless of the shape, the lower surface is preferably flat and has a rounded edge extending all the way around it. It is preferable though that both the upper surface and lower surface have the same shape and that both are flat. More preferably, the upper surface and lower surface are both circular-shaped and flat. When circular-shaped, the upper surface has a diameter of from about 20 to about 30 inches and preferably a diameter of about 24 inches. Also, when circular-shaped, the lower surface has a diameter of from about 11 to about 17 inches and preferably a diameter of about 13 inches.

The top part of the base is attached to the upper surface of the bottom part of the base by bolts, screws and/or plugs. It is preferred that the top part of the base has the same shape as the upper surface of the bottom part of the base. Also, the top part preferably has a perimeter covering at least the perimeter of the upper surface of the bottom part. Preferably, the top part is circular-shaped and has a diameter of from about 20 to about 30 inches. More preferably, the top part has a diameter of about 24 inches. Also, the top part has a thickness of from about 0.25 to about 1.0 inches.

The top part of the base can be made of wood and/or fiberglass. Preferably, the top part of the base is made of wood and more preferably plywood. In use, the base is preferably encased within a rubber mold.

The base has a height of from about 5 to about 14 inches. Preferably, the base has a height of about 8 inches.

The column is supported on the top part of the base and extends substantially vertically upward from the top part of the base. Preferably, the column is supported on the top part of the base at a central location. The column can be attached to the top part of the base by any commercial grade glue. The column is preferably comprised of very heavy dense foam. The material the column is comprised of should provide resistance to a hit by the user but also should not be too rigid to hurt the user. The material should also be of a density sufficient to cause the force of a hit by the user to be exerted on the top part of the base. Commercially available foam suitable for use with this invention preferably has a density of about 1.3 pounds and a firmness (I.L.D.) of about 40 pounds. One such commercially available foam can be obtained from Foam Rubber Fabracators in Belleville, N.J. (Part Number 1340).

Also, the column can be constructed in a variety of geometric shapes such as cylindrical-shaped, hexagonal-shaped, octagonal-shaped, etc., without departing from the scope and purpose of the present invention. The column has a length of from about 4 to about 7 feet. Preferably, the column has a length of about 5 feet. The column has a width of about 10 to about 16 inches. Preferably, the column has a width of about 12 inches.

Further, the column can have straps attached on its sides near the top end of it so that the user can balance when doing leg raises, kicks or squats. Suitable straps that can be used with the present invention can be obtained from Trimline, Inc. in New York, N.Y.

The column preferably includes foam encased within a sleeve and the sleeve has an edge portion extending beyond the column whereby the column is supported on the top part of the base by attaching the end portion of the sleeve to the top part. The edge portion of the sleeve can be attached to the top part by heat-sealing it to the top part and/or by staples, nails, plugs and/or screws.

The sleeve is preferably made of a vinyl or a nylon-coated vinyl. The sleeve preferably has a thickness of from about 0.1 cm to about 0.3 cm and more preferably a thickness of about 0.2 cm.

A preferred embodiment of the present invention includes a training bag apparatus having a base, a column and a sleeve wherein the column and the base are an integral one-piece unit and move in the same direction when the sleeve is struck. The base has an upper surface and a lower surface. The lower surface is preferably flat and has a rounded edge extending all the way around it. Preferably, the upper surface of the base is spaced above the lower surface and the upper surface has a greater surface area than the lower surface. Further, the upper surface and lower surface can be of a variety of geometric shapes such as square-shaped, rectangular-shaped, circular-shaped, triangular-shaped, hexagonal-shaped and octagonal-shaped. It is preferable that both the upper surface and lower surface have the same shape and that both are flat. More preferably, the upper surface and lower surface are both circular-shaped and flat. When circular-shaped, the upper surface has a diameter of from about 20 to about 30 inches and preferably a diameter of about 24 inches. Also, when circular-shaped, the lower surface has a diameter of from about 11 to about 17 inches and preferably a diameter of about 13 inches.

The base of this embodiment is preferably hollow and is filled with a material having a weight that would allow the base to tilt away from the user on a portion of the rounded edge of its lower surface when the apparatus is struck by the user, then tilt back towards the user on an opposite portion of the rounded edge and then tilt back and forth until the apparatus returns to its normal vertical position. The weight of the material should also be sufficient enough to prevent the apparatus from having moved substantially away from the user when the apparatus returns to its normal vertical position. Preferably, the upper surface of the base has an opening through which the base can be filled with such material. The base preferably can be filled with concrete and/or sand. Concrete and sand can be obtained at several retailers or commercial construction companies.

The base is preferably a molded plastic that is hollow. It can be made by several conventional methods including injection fusion molding and blow molding. The plastic preferably has a thickness of from about 0.0625 to about 0.50 inches and more preferably a thickness of about 0.125 inches. Most conventional plastics can be used to make the base as they are not rigid enough to injure a user who inadvertently kicks the base. A preferred plastic for use with the present invention is high density polyethylene which is commercially available from many companies such as Injectron Corporation in Plainfield, N.J.

The base can alternatively be made from wood shaped to have an upper surface and a lower surface with the dimensions set forth herein. In such case, the base should be encased within a rubber mold or other casing which would prevent a user who inadvertently kicks the base from being injured.

The base has a side surface extending all the way around the base. An axle connecting a pair of wheels can extend through a portion of the base on the side surface so that the user can move the training bag apparatus.

The base has a height of from about 5 to about 14 inches. Preferably, the base has a height of about 8 inches.

The column has a top end and a bottom end and the bottom end is supported at a central location on the upper surface of the base. The column extends substantially vertically upward from the upper surface of the base. The column is preferably comprised of very heavy dense foam. The material the column is comprised of should provide resistance to a hit by the user but also should not be too rigid to hurt the user. The material should also be of a density sufficient to cause the force of a hit by the user to be exerted on the top part of the base. Commercially available foam suitable for use with this embodiment preferably has a density of about 1.3 pounds and a firmness (I.L.D.) of about 40 pounds. One such commercially available foam can be obtained from Foam Rubber Fabracators in Belleville, N.J. (Part Number 1340).

Further, the column can have straps attached on its sides near the top end of it so that the user can balance when doing leg raises, kicks or squats.

Also, the column can be constructed in a variety of geometric shapes such as cylindrical-shaped, hexagonal-shaped, octagonal-shaped, etc., without departing from the scope and purpose of the present invention. The column has a length of from about 4 to about 7 feet. Preferably, the column has a length of about 5 feet. The column has a width of about 10 to about 16 inches. Preferably, the column has a width of about 12 inches.

The sleeve is sized and shaped to cover a significant portion of the column and extend onto the upper surface of the base. The portion of the sleeve extending onto the upper surface of the base is the edge portion which is attached to the upper surface of the base to thereby hold the column on the upper surface of the base. The edge portion of the sleeve can be attached to the upper surface of the base by heat-sealing it to the upper surface and/or by staples, nails, plugs and/or screws. Preferably, the sleeve is sized and shaped to fit tightly over the top end and sides of the column so as to maintain the shape of the column.

The sleeve is preferably made of a vinyl or a nylon-coated vinyl. The sleeve preferably has a thickness of from about 0.1 cm to about 0.3 cm and more preferably a thickness of about 0.2 cm. Vinyl or a nylon-coated vinyl for making the sleeve can be obtained from Kaltex Corporation in New York, N.Y.

Another preferred embodiment of the present invention includes a training bag apparatus having a base, a column, a sleeve and a lid wherein the column and the base are an integral one-piece unit and move in the same direction when the sleeve is struck. The base includes a lower surface and an upper surface wherein the lower surface has a rounded edge extending all the way around it and the upper surface has a central receiving region. The lower surface is preferably flat and substantially circular. Further, the lower surface can be constructed in a variety of geometric shapes such as square-shaped, rectangular-shaped, circular-shaped, triangular-shaped, hexagonal-shaped and octagonal-shaped. When circular-shaped, the lower surface has a diameter of from about 11 to about 17 inches and more preferably a diameter of about 13 inches.

Preferably, the upper surface of the base is spaced above the lower surface and the edge of the upper surface has a greater perimeter than the edge of the lower surface. Further, the upper surface can be constructed in a variety of geometric shapes such as square-shaped, rectangular-shaped, circular-shaped, triangular-shaped, hexagonal-shaped and octagonal-shaped. When circular-shaped, the upper surface has a circumference of from about 62 to about 94 inches and more preferably a circumference of about 75 inches. It is preferable that both the upper surface and lower surface have the same shape and that both are flat.

The central receiving region has a width of from about 10 to about 16 inches and a height of about 4 to about 16 inches.

Preferably, the central receiving region has a width of about 12 inches and a height of about 8 inches.

The base of this embodiment is preferably hollow and is filled with a material having a weight that would allow the base to tilt away from the user on a portion of the rounded edge of its lower surface when the apparatus is struck by the user, then tilt back towards the user on an opposite portion of the rounded edge and then tilt back and forth until the apparatus returns to its normal vertical position. The weight of the material should also be sufficient enough to prevent the apparatus from having moved substantially away from the user when the apparatus returns to its normal vertical position. Preferably, the base is filled with concrete and/or sand. Concrete and sand can be obtained at several retailers or commercial construction companies.

It should be appreciated that conventional training bags weigh between 40 and 120 pounds. The training bag apparatus of the present invention filled with concrete weighs from about 70 to 110 pounds and preferably from about 90 to about 100 pounds, but provides better conditioning benefits than heavier or lighter conventional training bags. At this weight, the training bag apparatus, when struck by a user, will tilt away from the user, then tilt back towards the user and then tilt back and forth until returning to its normal vertical position. This weight should also be sufficient enough to prevent the apparatus from having moved substantially away from the user when the apparatus returns to its normal vertical position.

The base is preferably a molded plastic that is hollow. It can be made by several conventional methods including injection fusion molding and blow molding. The plastic preferably has a thickness of from about 0.0625 to about 0.50 inches and more preferably a thickness of about 0.125 inches. Most conventional plastics can be used to make the base as they are not rigid enough to injure a user who inadvertently kicks the base. A preferred plastic for use with the present invention is high density polyethylene which is commercially available from several companies such as Injectron Corporation in Plainfield, N.J.

Further, the base preferably has a side surface extending around the base. The lid can be attached to the upper part of the side surface of the base. Also, an axle connecting a pair of wheels can extend through a portion of the base on the side surface so that the user can move the training bag apparatus.

The base has a height of from about 5 to about 14 inches. Preferably, the base has a height of about 8 inches.

The column has a bottom end and a top end and the bottom end is received in the central receiving region of the upper surface of the base such that the column extends substantially vertically upward from the base.

The column of this embodiment is preferably supported in the central receiving region at a point below the upper surface of the base. Further, the column can have straps attached on its sides near the top end of it so that the user can balance when doing leg raises, kicks or squats.

The material the column is comprised of should provide resistance to a hit by the user but also should not be too rigid to hurt the user. The material should also be of a density sufficient to cause the force of a hit by the user to be exerted on the top part of the base.

The column is preferably comprised of very heavy dense foam. Commercially available foam suitable for use with this embodiment preferably has a density of about 1.3 pounds and a firmness (I.L.D.) of about 40 pounds. One such commercially available foam can be obtained from Foam Rubber Fabracators in Belleville, N.J. (Part Number 1340).

The column has a length of from about 4 to about 7 feet. Preferably, the column has a length of about 5 feet. The column has a width of about 10 to about 16 inches. Preferably, the column has a width of slightly less than about 12 inches. Further, about 4 to about 16 inches of the bottom end of the column is supported in the central receiving region of the base. Preferably, about 8 inches of the bottom end of the column is supported in the central receiving region of the base.

The sleeve is sized and shaped to cover a significant portion of the column and extend onto the upper surface of the base. The portion of the sleeve extending onto the upper surface of the base is the edge portion. Preferably, the sleeve is sized and shaped to fit tightly over the top end and sides of the column so as to maintain the shape of the column.

The sleeve is preferably made of a vinyl or a nylon-coated vinyl. The sleeve preferably has a thickness of from about 0.1 cm to about 0.3 cm and more preferably a thickness of about 0.2 cm. Vinyl or a nylon-coated vinyl for making the sleeve can be obtained from Kaltex Corporation in New York, N.Y.

The lid has a central opening wherein the lid is sized and shaped to fit over the sleeve and attach to the base such that the lid holds the edge portion of the sleeve and thereby the column in the central receiving region of the upper surface of the base. For additional strength in holding the edge portion of the sleeve in place, the edge portion of the sleeve can be attached to the upper surface of the base by heat-sealing it to the upper surface and/or by staples, nails, plugs and/or screws. The lid is shaped to correspond to the upper surface of the base and it is sized so that it will fit snugly over the upper surface of the base. The central opening has a diameter slightly larger than the diameter of the column. The central opening will generally have a width in the range of from about 10 to about 16 inches.

Preferably, the lid is attached to the base via a snap and lock engagement in which the lid has a plurality of rivets extending all the way around a side surface of it which snap into apertures which extend all the way around the upper part of the side surface of the base. The rivets preferably have a width of about 0.125 to about 0.50 inches and a depth of about 0.25 to about 2 inches and the apertures preferably have a width of about 0.125 to about 0.50 inches and a depth of about 0.25 to about 2 inches. The lid can alternatively be attached to the base by heat-sealing the inner part of the side surface of the lid to the upper part of the side surface of the base and/or by using bolts, screws and/or plugs.

The lid has a width or diameter of from about 20 to about 30 inches. Preferably, the lid has a width or diameter of about 24 inches. The lid has a thickness of from about 0.0625 to about 0.250 inches. Preferably, the lid has a thickness of about 0.125 inches.

The lid is preferably made of a molded plastic. It can be made by several conventional methods including injection fusion molding and blow molding. Most conventional plastics can be used to make the lid as they are not rigid enough to injure a user who inadvertently kicks the lid. A preferred plastic for use with the present invention is high density polyethylene.

It is preferred that the training bag apparatuses of the present invention have a pair of wheels extending through a portion of the base. The pair of wheels should be connected by an axle and can located be on the side surface of the base such that the pair of wheels are elevated off of the ground and will not touch the ground during normal usage of the training bag apparatus. The wheels are preferably 3.75 inches in height and 2.16 inches in width. A pair of wheels having these dimensions is available at Exxex Caster & Rubber Corp. in Perth Amboy, N.J. (Item Number 8862). With the pair of wheels, a training bag apparatus can be moved by pulling the column back such that the pair of wheels are on the ground or floor and then moving the apparatus.

Referring now more specifically to the Figures, in which identical or similar parts are designated by the same reference numerals throughout, and first referring to the preferred embodiment shown in FIG. 1, the training bag apparatus of the present invention is generally designated by the reference numeral 10. The training bag apparatus 10 includes a base 12 which is generally hollow and a sleeve 16 which includes a column 14 (not shown in FIG. 1). The base 12 is preferably filled with concrete prior to inserting the column 14 into the central receiving region 20 (not shown in FIG. 1) of the base 12, but can also be filled with sand.

Figure 2:
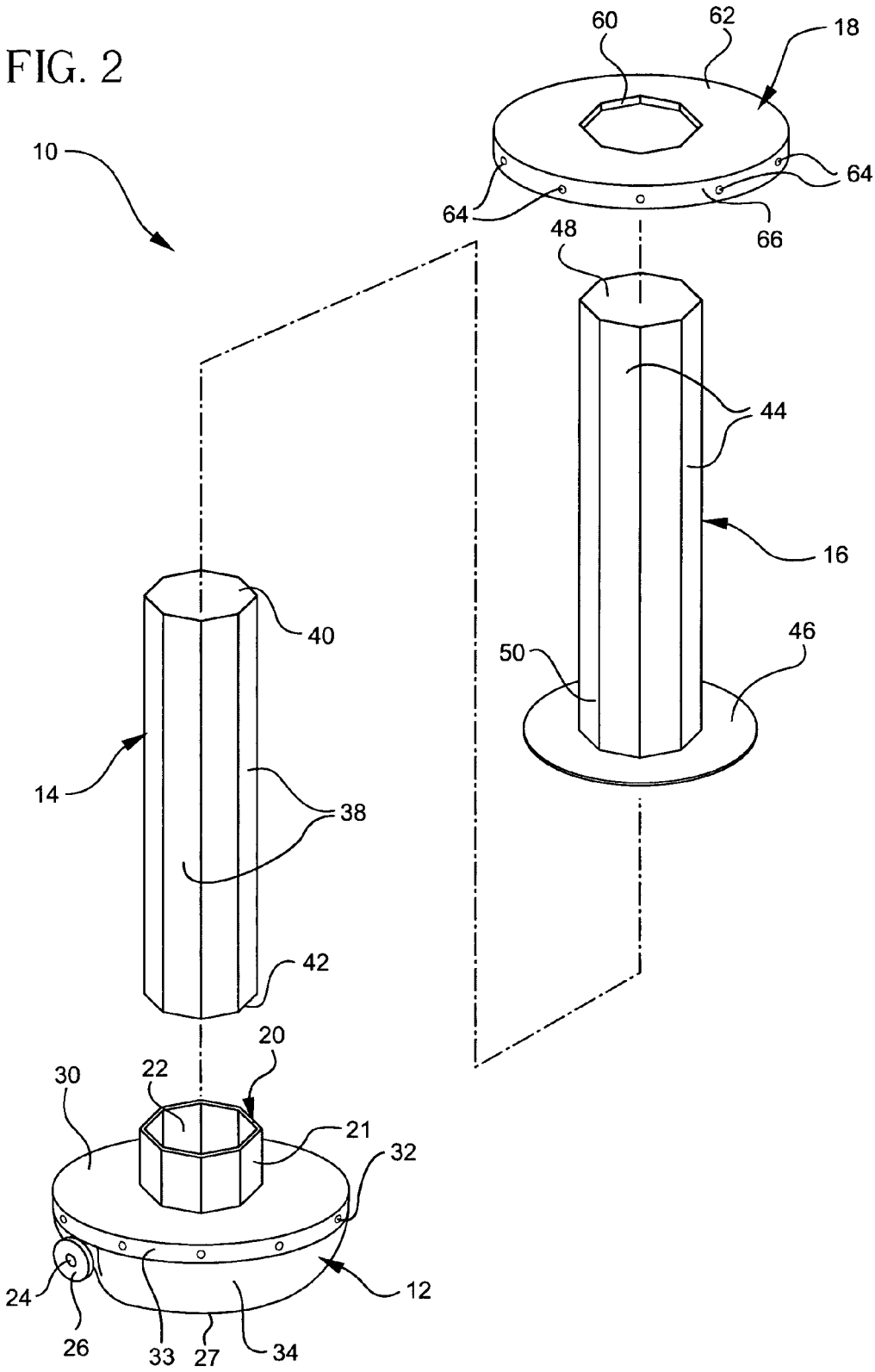
FIG. 2 is an exploded, perspective view of the training bag apparatus shown in FIG. 1.
Figure 3:
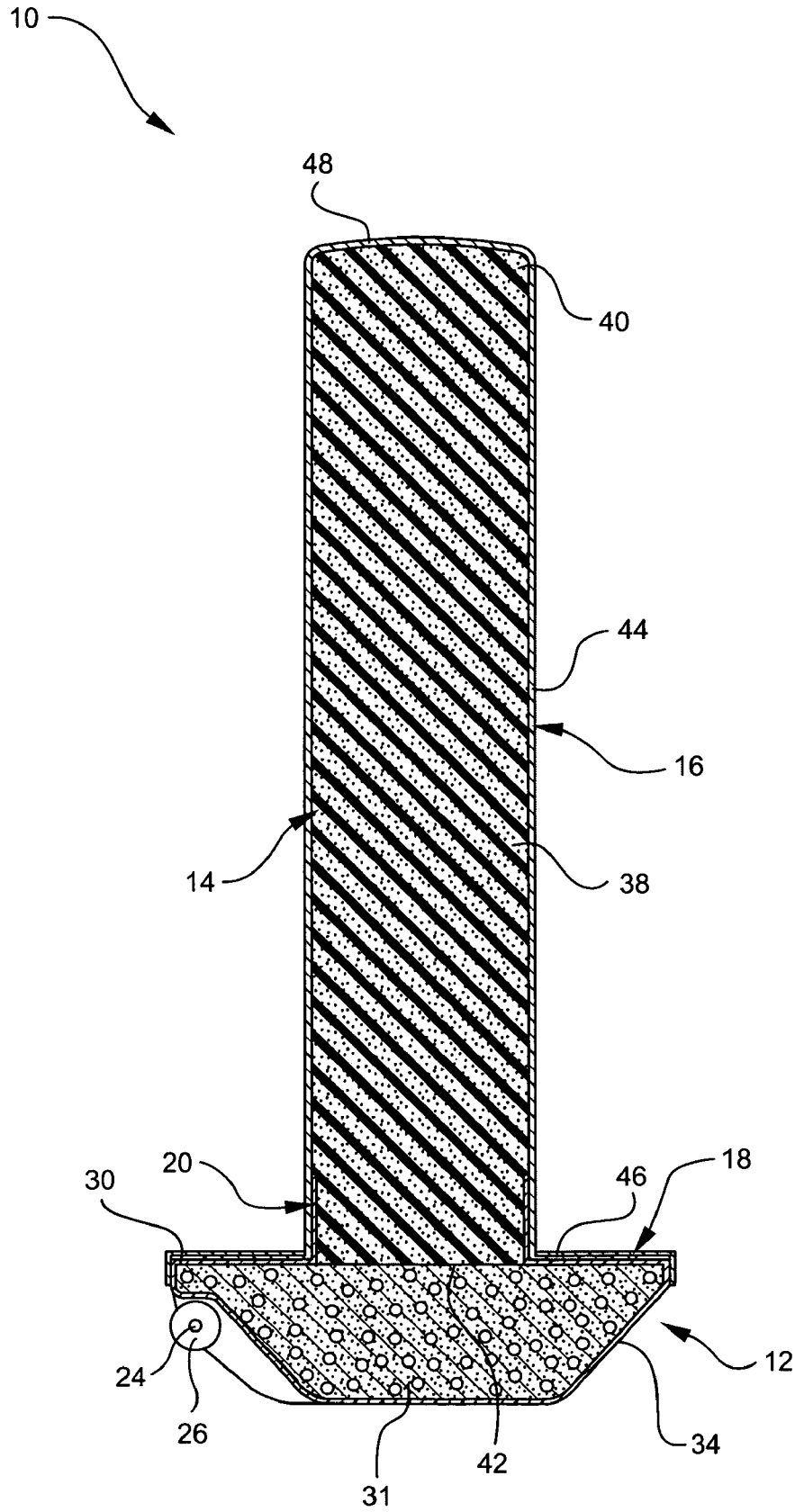
FIG. 3 is a cross-sectional view of the training bag apparatus shown in FIG. 1.
Figure 4:
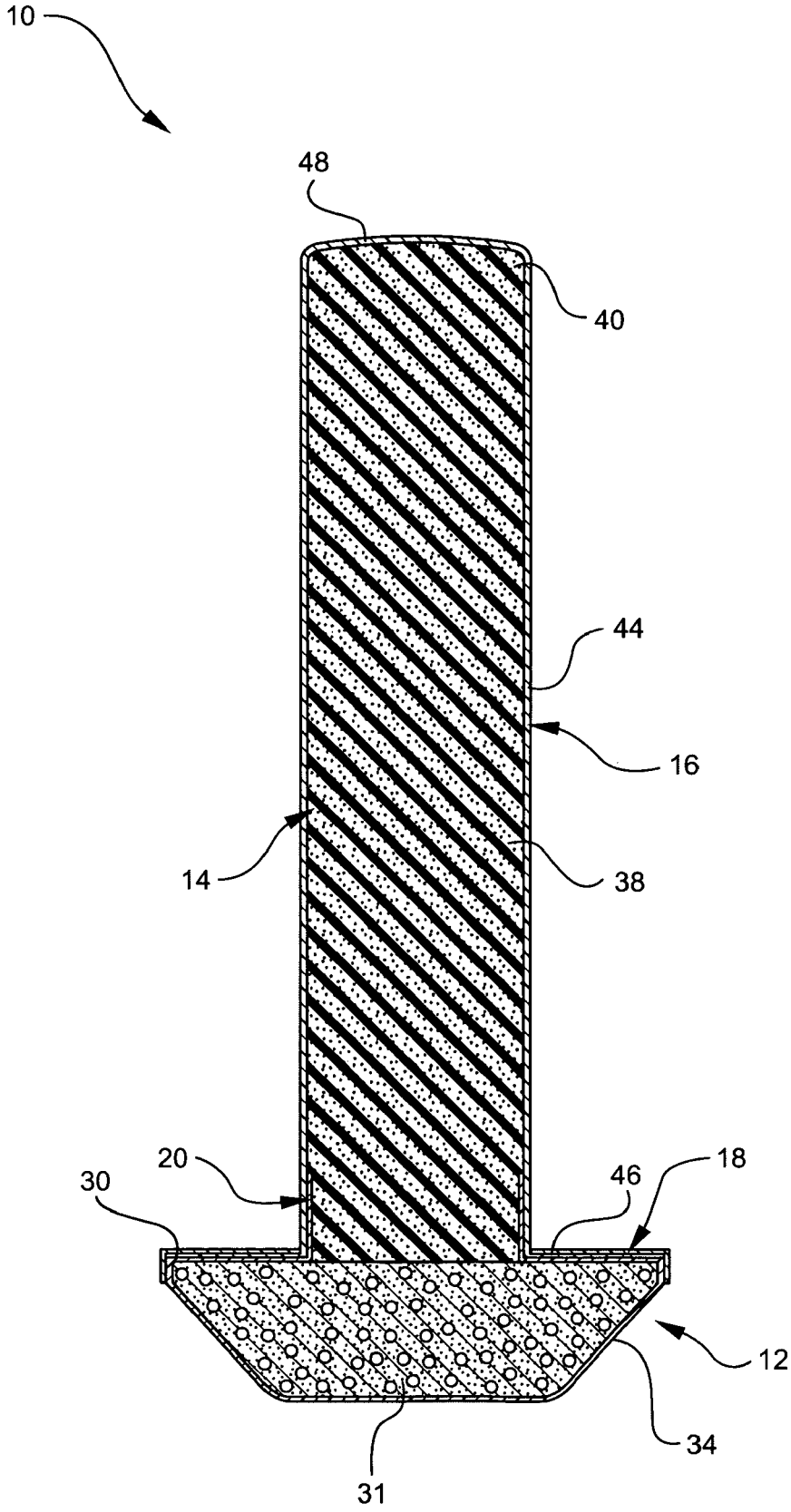
FIG. 4 is another cross-sectional view of the training bag apparatus shown in FIG. 1.

The column 14 is not shown in FIG. 1, but can be seen in FIGS. 2-4. The sleeve 16 and column 14 are octagonal-shaped in FIG. 1, but can be constructed in a variety of geometric shapes such as cylindrical-shaped and hexagonal-shaped. The specific shape of the sleeve 16 and column 14 is not critical for purposes of the invention as long as the sleeve 16, column 14 and central receiving region 20 of the base 12 (see FIG. 2) are provided with the same shape. The column 14 of the training bag apparatus 10 shown in FIG. 1 is received in the central receiving region 20 of the base 12 (see FIG. 2) and is held in place by a lid 18 which fits over the sleeve 16. The lid 18 is attached to the base 12 by a plurality of rivets 64 on its side surface 66 which lock into the apertures 32 (see FIG. 2) in the upper part 33 of the side surface 34 of the base 12. A plurality of the apertures 32 extend all the way around the upper part 33 of the side surface 34 of the base 12. The training bag apparatus 10 shown in FIG. 1 also has a pair of wheels 26 which are connected by an axle 24. The axle 24 extends through a portion of the base 12. The pair of wheels 26 are located on the side surface 34 of the base 12 such that the pair of wheels 26 are elevated off of the ground and will not touch the ground during normal usage of the training bag apparatus 10. The training bag apparatus can be moved by pulling the sleeve 16 and column 14 back such that the pair of wheels 26 are on the ground or floor and the training bag apparatus 10 can then be moved using the pair of wheels 26.

FIG. 2 is an exploded, perspective view of the training bag apparatus shown in FIG. 1. The base 12 includes a lower surface 27, an upper surface 30 and a side surface 34 extending all the way around the base 12. The lower surface 27 is flat and has a rounded edge extending all the way around it. The base 12 also has a central receiving region 20 for receiving the column 14, and a pair of wheels 26 connected by an axle 24 which extends through a portion of the base 12 on its side surface 34. The base 12 also has an upper part 33 of the side surface 34 having a plurality of apertures 32 extending all the way around the upper part 33. The apertures 32 receive the rivets 64 of the lid 18.

The column 14 has a top end 40 and a bottom end 42 which is sized and shaped to be tightly received within the inner surface 22 of the central receiving region 20 of the base 12. The column 14 is supported in the central receiving region 20 at a point below the upper surface 30 of the base 12. Preferably, the base is filled with cement and the column 14 is supported in the central receiving region 20 on the cement. The column 14 receives the sleeve 16 such that the lower end 50 of the sleeve 16 fits over the outer surface 21 of the central receiving region 20. Further, the sleeve 16 has an end portion 46 which extends onto the upper surface 30 of the base 12. The sleeve 16 should be sized and shaped to tightly fit over the column 14 and the lower end 50 of the sleeve 16 should be sized to tightly fit over the outer surface 21 of the central receiving region 20 of the base 12. The sleeve 16 has side surfaces 44 and a top end 48 which tightly fit over the side surfaces 38 and top end 40 of the column 14.

The lid 18 has a central opening 60 which is sized and shaped to fit tightly over the sleeve 16. The lid 18 also has a top surface 62 and a side surface 66 extending all the way around it and the side surface 66 has a plurality of rivets 64. The top surface 62 and the side surface 66 of the lid 18 are sized and shaped so that the lid 18 tightly fits over the upper surface 30 of the base 12 and the rivets 64 of the lid 18 snap and lock into the apertures 32 on the upper part 33 of the side surface 34 of the base 12.

When the training bag 10 shown in FIG. 2 is assembled, it is preferable that the base 12 is filled with concrete prior to inserting the column 14 into the central receiving region 20 of the base 12. After the concrete is dried in the base 12, the column 14 is inserted into the central receiving region 20 such that its side surfaces 38 align with the inner surface 22 of the central receiving region 20. The column 14 is supported on top of the concrete at a point below the upper surface 30 of the base 12. The column 14 should be tightly secured in the central receiving region 20. The column 14 then receives the sleeve 16 such that the lower end 50 of the sleeve 16 fits over the outer surface 21 of the central receiving region 20. The top end 48 of the sleeve 16 should fit tightly over the top end 40 of the column 14 and the sleeve 16 has an end portion 46 which extends onto the upper surface 30 of the base 12. The lid 18 is then inserted onto the sleeve 16 and the upper surface 30 of the base 12. It is important that when the lid 18 is inserted onto the top end 48 of the sleeve 16, the central opening 60 of the lid 18 is aligned such that it will fit properly over the side surfaces 44 of the sleeve 16 which fit tightly over the side surfaces 38 of the column 14. The plurality of rivets 64 of the lid 18 are then snapped and locked into the apertures 32 of the upper part 33 of the side surface 34 of the base 12.

The lid 18 can alternatively be attached to the base 12 by heat-sealing the inner part of the side surface 66 of the lid 18 to the upper part 33 of the side surface 34 of the base 12 and/or by using bolts, screws and/or plugs.

FIG. 3 is a cross-sectional view of the training bag apparatus shown in FIG. 1 which more clearly shows an assembled training bag apparatus 10 of the present invention. The base 12 is filled with concrete 31 and the bottom end 42 of the column 14 is supported on the concrete 31 at a point below the upper surface 30 of the base 12. The lower part of the column 14 is tightly fit into the central receiving region 20 of the base 12. The sleeve 16 is tightly fit over the column 14 such that there are no spaces or bubbles between the column 14 and the sleeve 16. It can be clearly seen in FIG. 3 that the top end 48 of the sleeve 16 fits tightly over the top end 40 of the column 14 and that there are no spaces or bubbles between the top end 48 of the sleeve 16 and the top end 40 of the column 14. The lid 18 is attached over the end portion 46 of the sleeve 16 onto the upper surface 30 of the base 12.

The base 12 of the training bag apparatus 10 shown in FIG. 3 also has a pair of wheels 26, one of which is shown, on its side surface 34. The pair of wheels 26 are elevated off of the ground or floor such that they do not interfere with normal operation of the training bag apparatus 10.

FIG. 4 is another cross-sectional view of the training bag apparatus 10 shown in FIG. 1. The view in FIG. 4 is from a different angle than that in FIG. 3. The only difference between FIGS. 3 and 4 is that in FIG. 4, the pair of wheels 26 cannot be seen because the view is from the side of the training bag apparatus 10 which is opposite of the side with the pair of wheels 26.

Figure 5:
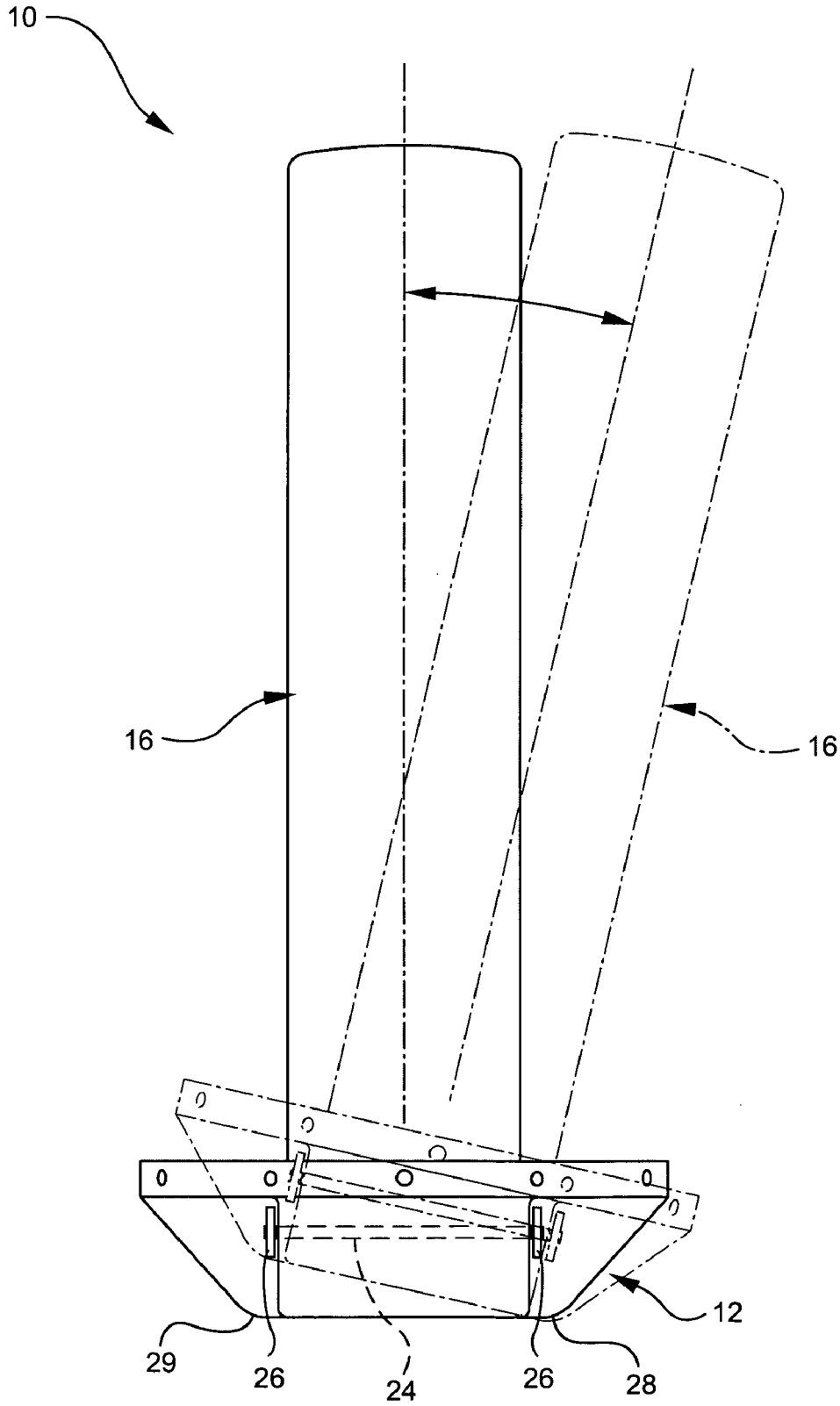
FIG. 5 shows a training bag apparatus of the present invention wherein the column has just been struck.

FIG. 5 shows how a preferred training bag apparatus 10 of the present invention moves after the sleeve 16 has been struck. In FIG. 5, the pair of wheels 26 is clearly shown in the base 12 as well as the axle 24 which connects and holds the pair of wheels 26. Dashed lines show the axle 24 as it extends through a portion of the base 12 on its side surface 34.

It is readily apparent from FIG. 5 that when the training bag 10 is struck by a user, the base 12 and sleeve 16 move as an integral one-piece unit. In particular, when the sleeve 16 is struck with a significant force, the base 12 will tilt on the rounded edge 28 of its lower surface opposite from the side struck by the user. The base 12 will then tilt back on the rounded edge 29 of its lower surface on the side struck by the user and then continue to tilt back and forth on the rounded edges 28 and 29 until the training bag 10 returns to its normal vertical position. As a result, the sleeve 16 will not rebound significantly and strike the user.

Figure 6:
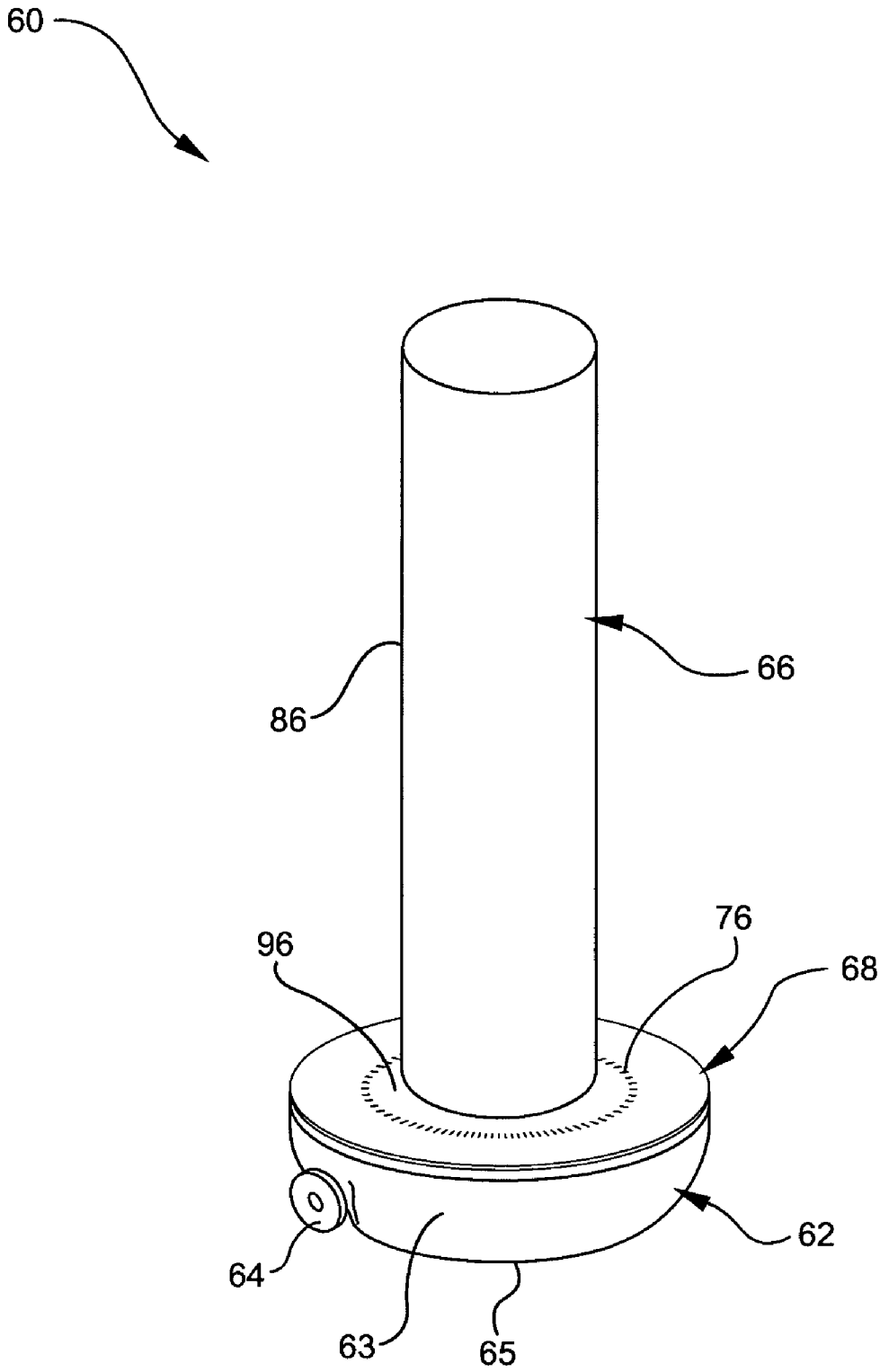
FIG. 6 is a perspective view of another preferred training bag apparatus constructed in accordance with the present invention.

FIG. 6 is a perspective view of another preferred training bag apparatus 60 constructed in accordance with the present invention. The base 62 includes a bottom part 63 and a top part 68. The bottom part 63 has an upper surface (not shown) with a large opening (not shown) and a lower surface 65 which has a rounded edge extending all the way around it. The bottom part 63 of the base 62 is generally hollow and is filled through the large opening on the upper surface of the bottom part 63 with a material that would allow the base 62 to tilt away from the user when the apparatus 60 is struck by the user, then tilt back towards the user and then tilt back and forth until the apparatus 60 returns to its normal vertical position. The material should have a weight sufficient enough to prevent the apparatus 60 from having moved substantially away from the user when the apparatus 60 returns to its normal vertical position. Preferably, the bottom part 63 is filled with concrete and/or sand. The bottom part 63 also has a pair of wheels 64 which allow the user to move the training bag apparatus 66 as needed.

The top part 68 is attached to the upper surface of the bottom part 63 of the base 62 by bolts (not shown), but can alternatively be attached by screws and/or plugs. The top part 68 of the base 62 is made of wood, but can alternatively be made of fiberglass. Preferably, the top part 68 is attached to the bottom part 63 after the bottom part 63 is filled with a material as discussed above.

The cylindrical-shaped column 66 is supported on the top part 68 of the base 62 and extends substantially vertically upward from the top part 68 of the base 62. The column 66 and the base 62 are an integral one-piece unit and move in the same direction when the column is struck.

The column 66 includes foam encased within a sleeve 86 and the sleeve 86 has an end portion 96 which extends beyond the column 66 whereby the column 66 is supported on the top part 68 of the base 62 by attaching the end portion 96 of the sleeve 86 to the top part 68. In FIG. 6, the end portion 96 of the sleeve 86 is attached to the top part 68 of the base 62 by staples 76, but can alternatively be attached by heat-sealing the end portion 96 to the top part 68 and/or by using bolts, screws and/or plugs.

Figure 7:
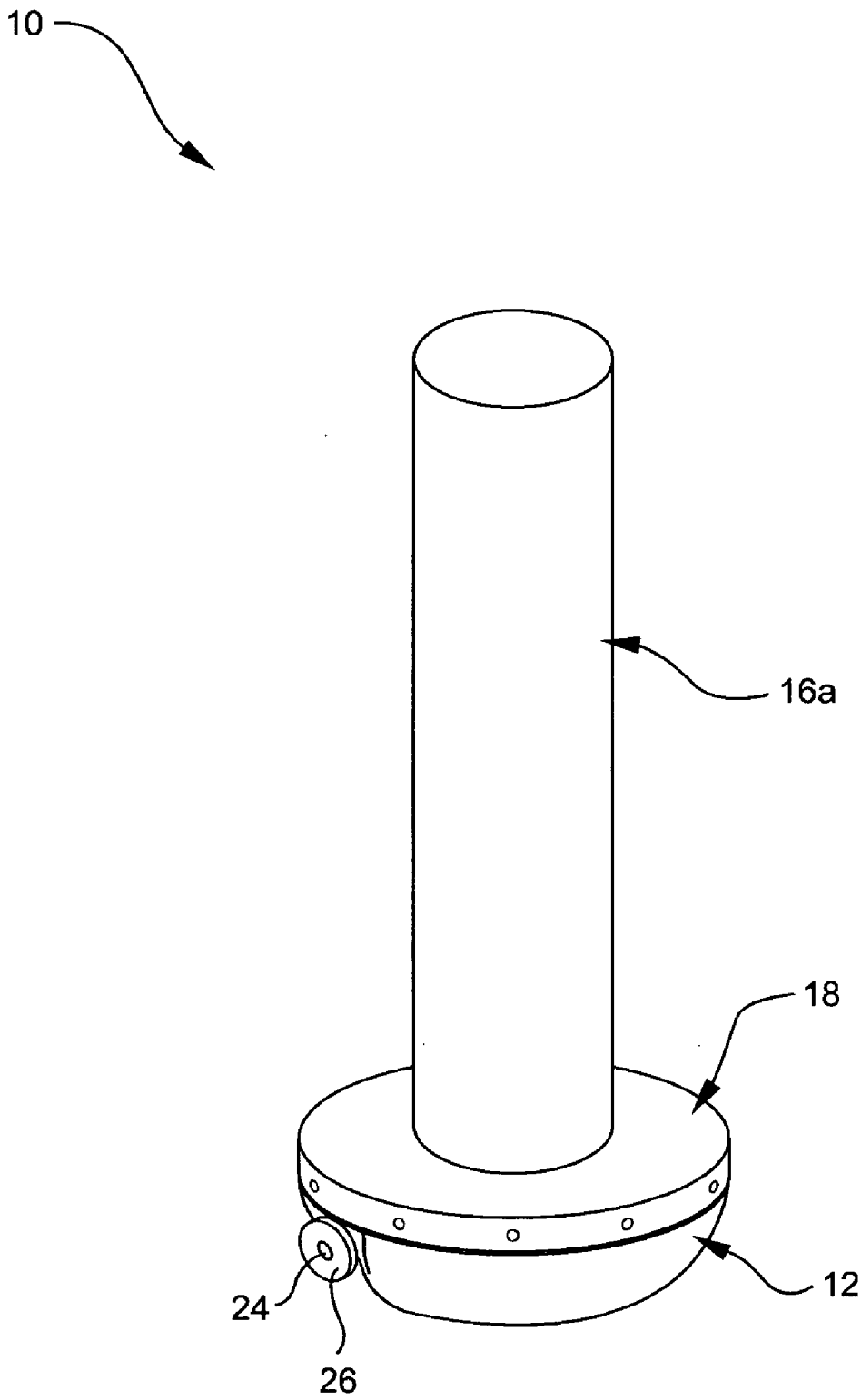
FIG. 7 is a perspective view of another preferred training bag apparatus constructed in accordance with the present invention.

FIG. 7 shows another preferred training bag apparatus 10 constructed in accordance with the present invention. The training bag apparatus 10 is the same as the training bag apparatus 10 shown in FIG. 1, except that the sleeve **16*a* and column (not shown) in FIG. 7 are cylindrical rather than octagonal-shaped. As with the training bag apparatus shown in FIG. 1, the training bag apparatus 10 shown in FIG. 7 includes a base 12 which is generally hollow and a sleeve 16*a* which includes a column (not shown). Also, the training bag apparatus 10 shown in FIG. 7 has a pair of wheels 26 which are connected by an axle 24 which extends through a portion of the base 12. The training bag 10 can be moved by pulling the sleeve 16*a* (and thereby the column) back such that the pair of wheels 26 are on the ground or floor and the training bag apparatus 10 can then be moved using the pair of wheels 26**.

Thus, while there have been described what are presently believed to be the preferred embodiments of the present invention, those skilled in the art will realize that other and further embodiments can be made without departing from the spirit of the invention, and it is intended to include all such further modifications and changes as come within the true scope of the claims set forth herein.

What is claimed is:

1. A training bag apparatus comprising:

(a) a base comprising: (1) a bottom part having an upper surface and a lower surface, said lower surface having a rounded edge extending around said lower surface; and (2) a top part attached to said upper surface of said bottom part of said base; and (b) a column supported on said top part of said base and extending substantially vertically upward from said top part of said base, said column consisting of foam encased within a sleeve;

wherein said column and said base are an integral one-piece unit and move in the same direction when said column is struck by a user such that said apparatus tilts away from the user, then said apparatus tilts back toward the user and then said apparatus tilts back and forth away and toward the user until said apparatus returns to a vertical position; and wherein said upper surface of said bottom part is spaced above said lower surface and said upper surface has a greater surface area than said lower surface.

2. The training bag apparatus of claim 1, wherein said bottom part of said base comprises concrete.

3. The training bag apparatus of claim 1, wherein said top part of said base comprises wood.

4. The training bag apparatus of claim 1, wherein said sleeve has a length extending beyond the column whereby the column is supported on said top part by attaching the sleeve to said top part.

5. The training bag apparatus of claim 1, wherein said column is cylindrical-shaped, hexagonal-shaped or octagonal-shaped.

6. The training bag apparatus of claim 1, wherein said top part has a perimeter covering at least the perimeter of said upper surface of said bottom part.

7. A training bag apparatus comprising:

(a) a base having an upper surface and a lower surface, said lower surface having a rounded edge extending around said lower surface;

(b) a column having a top end and a bottom end, said bottom end of said column supported at a central location on said upper surface of said base and said column extending substantially vertically upward from said upper surface of said base; and (c) a sleeve sized and shaped to cover a significant portion of said column and extend onto said upper surface of said base, said sleeve having an outwardly extending edge portion attached to said upper surface of said base to thereby hold said column on said upper surface of said base;

wherein said column comprises foam, and said column and said base are an integral one-piece unit and move in the same direction when said sleeve is struck by a user such that said apparatus tilts away from the user, then said apparatus tilts back toward the user and then said apparatus tilts back and forth away and toward the user until said apparatus returns to a vertical position.

8. The training bag apparatus of claim 7, wherein said upper surface of said base is spaced above said lower surface and said upper surface has a greater surface area than said lower surface.

9. The training bag apparatus of claim 7, wherein said base is generally hollow.

10. A training bag apparatus comprising:

(a) a base comprising a lower surface and an upper surface, said lower surface having a rounded edge extending around said lower surface, said upper surface having a central receiving region;

(b) a column having a bottom end and a top end, said bottom end received in said central receiving region such that said column extends substantially vertically upward from said base;

(c) a sleeve sized and shaped to cover a significant portion of said column and extend outwardly onto said upper surface of said base; and (d) a lid with a central opening wherein said lid is sized and shaped to fit over said sleeve and attach to said base such that said lid holds said sleeve and thereby said column in said central receiving region of said upper surface of said base;

wherein said column and said base are an integral one-piece unit and move in the same direction when said sleeve is struck by a user such that said apparatus tilts away from the user, then said apparatus tilts back toward the user and then said apparatus tilts back and forth away and toward the user until said apparatus returns to a vertical position; and wherein said upper surface of said base is spaced above said lower surface and said upper surface has a greater perimeter than said lower surface.

11. The training bag apparatus of claim 10, wherein said column is supported in said central receiving region at a point below said upper surface of said base.

12. The training bag apparatus of claim 10, wherein said base is generally hollow.

13. The training bag apparatus of claim 12, wherein said base is filled with concrete to increase the weight of said base.

14. The training bag apparatus of claim 10, wherein said lower surface is flat and substantially circular.

15. The training bag apparatus of claim 10, wherein said base has a side surface extending around said base and said lid is attached to said side surface of said base.

16. The training bag apparatus of claim 10, wherein said base has a side surface and a pair of wheels connected to an axle extending through said base on said side surface so that said training bag apparatus can be moved.

* * * * *